US006257914B1

(12) United States Patent
Comerci et al.

(10) Patent No.: US 6,257,914 B1
(45) Date of Patent: Jul. 10, 2001

(54) ELECTRICAL CONNECTOR WITH INTEGRAL LATCH AND STRAIN RELIEF DEVICE

(75) Inventors: Joseph D. Comerci, Elmhurst; George M. Simmel, Naperville, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/534,775

(22) Filed: Mar. 24, 2000

(51) Int. Cl.[7] ..... H01R 13/627
(52) U.S. Cl. ..... 439/357; 439/607; 439/610
(58) Field of Search ..... 439/357, 358, 439/607, 610, 353, 470, 460, 449, 352

(56) References Cited

U.S. PATENT DOCUMENTS 5,634,809 6/1997 Hirai ..... 439/352
5,660,558 8/1997 Osanai et al. ..... 439/353

FOREIGN PATENT DOCUMENTS

898333 A2 2/1999 (EP) .
898333 A3 3/1999 (EP) .

*Primary Examiner*—Brian Sircus
*Assistant Examiner*—Javaid Nasri
(74) *Attorney, Agent, or Firm*—Stephen Z. Weiss

(57) ABSTRACT

An electrical connector is provided for terminating an electrical cable and for mating with a complementary mating connector. A dielectric housing includes a front mating end, a rear terminating end and at least one mounting slot therein. A one-piece latch and strain relief device includes a central mounting portion, a forward latching portion and a rearward strain relief portion. The central mounting portion includes a mounting tab insertable into the mounting slot in the housing. The forward latching portion is adapted for latching engagement with the mating connector. The rearward strain relief portion is adapted for engaging the electrical cable. The one piece latch and strain relief device is electrically connected to the upper and lower shielding shells.

18 Claims, 6 Drawing Sheets

ELECTRICAL CONNECTOR WITH INTEGRAL LATCH AND STRAIN RELIEF DEVICE

FIELD OF THE INVENTION

This invention generally relates to the art of electrical connectors and, particularly, to an improved one-piece device which performs multiple functions of latching a connector to a mating connector as well as providing strain relief for an electrical cable terminated to the connector.

BACKGROUND OF THE INVENTION

Generally, a typical electrical connector includes some form of dielectric housing mounting a plurality of terminals which interengage with the terminals of a complementary mating connector or other connecting device. Often, some type of complementary interengaging latches are provided between the mating connectors to hold the connectors in mated condition. Electrical connectors often are terminated to discrete wires of an electrical cable, and some type of strain relief means is provided for preventing the cable from being pulled out of the connector. The latching means typically is at the front of the connector and the strain relief means is at the rear of the connector.

Problems continue to develop because of extraneous forces applied to electrical connectors of the character described above. Specifically, pulling forces on the mating connector create stresses on the latching means at the front of the connector. Pulling forces on the electrical cable create stresses on the rear portions of the terminals of the connector. Such forces tend to damage the various interengageable components of the connector.

Previous latching strain relief devices had some disadvantages. The devices were located totally on the exterior surface of the dielectric housing. To hold this device to the housing, apertures in mounting tabs had to be manufactured to snap on to projections on the housing or on a half shell portion. Manufacturing tolerances for the angle of the mounting tabs was critical for proper engagement with the apertures and was subject to damage during assembly which could change the angle. By providing a slot in the housing into which a mounting tab is inserted, expensive maintenance of close manufacturing tolerances can be avoided.

Another disadvantage with previous latching strain relief devices is a weakened aperture protrusion engagement. The force placed on the outer portion of the plug connector was passed to the cable through the engagement between the aperture and the protrusion. Because of the relatively small contact surfaces between the aperture and the protrusion high stresses were placed on the protrusion. The subject connector has a relatively larger contact surface between the straight edges of the tab and the straight walls of the mounting slot. This results in a relatively lower stress on the housing and therefore a greater force can be held.

Finally, with other latching strain relief devices, a separate means was needed to electrically connect the latching strain relief devices to the shell and the ground. Slots into which the latching strain relief mounting tabs are inserted, are shared with mounting tabs from the shell thereby simply and easily electrically joining the latching strain relief device with the shell and the ground.

The present invention is directed to solving these problems in a unique system wherein a one-piece device performs multiple functions and is rigidly secured to the housing of the connector.

SUMMARY OF THE INVENTION

An object, therefore, of the invention is to provide a new and improved electrical connector for terminating an electrical cable and for mating with a complementary mating connector or other connecting device.

In the exemplary embodiment of the invention, the connector includes a dielectric housing having a front mating end, a rear terminating end and at least one mounting slot therein. A plurality of terminals are mounted in the housing and extend generally between the mating and terminating ends thereof. A one-piece latch and strain relief device includes a central mounting portion, a forward latching portion and a rearward strain relief portion. The central mounting portion has a mounting tab insertable into the mounting slot in the housing. The forward latching portion is adapted for latching engagement with the mating connector. The rearward strain relief portion is adapted for embracing the electrical cable.

As disclosed herein, the one-piece latch and strain relief device is stamped and formed of sheet metal material. The forward latching portion is formed by at least one forwardly projecting latch arm. Preferably, a pair of hooked latch arms are provided at opposite sides of the front mating end of the housing. The latch arms are at least partially supported in slots in the housing. The rearward strain relief portion is formed by a crimp ring for clamping onto the electrical cable. The central mounting portion includes a pair of the mounting tabs press-fit into a pair of the mounting slots at opposite sides of the housing.

Another feature of the invention includes a shielding shell member beneath the one-piece latch and strain relief device. The shell member includes a mounting tab insertable into the mounting slot in the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
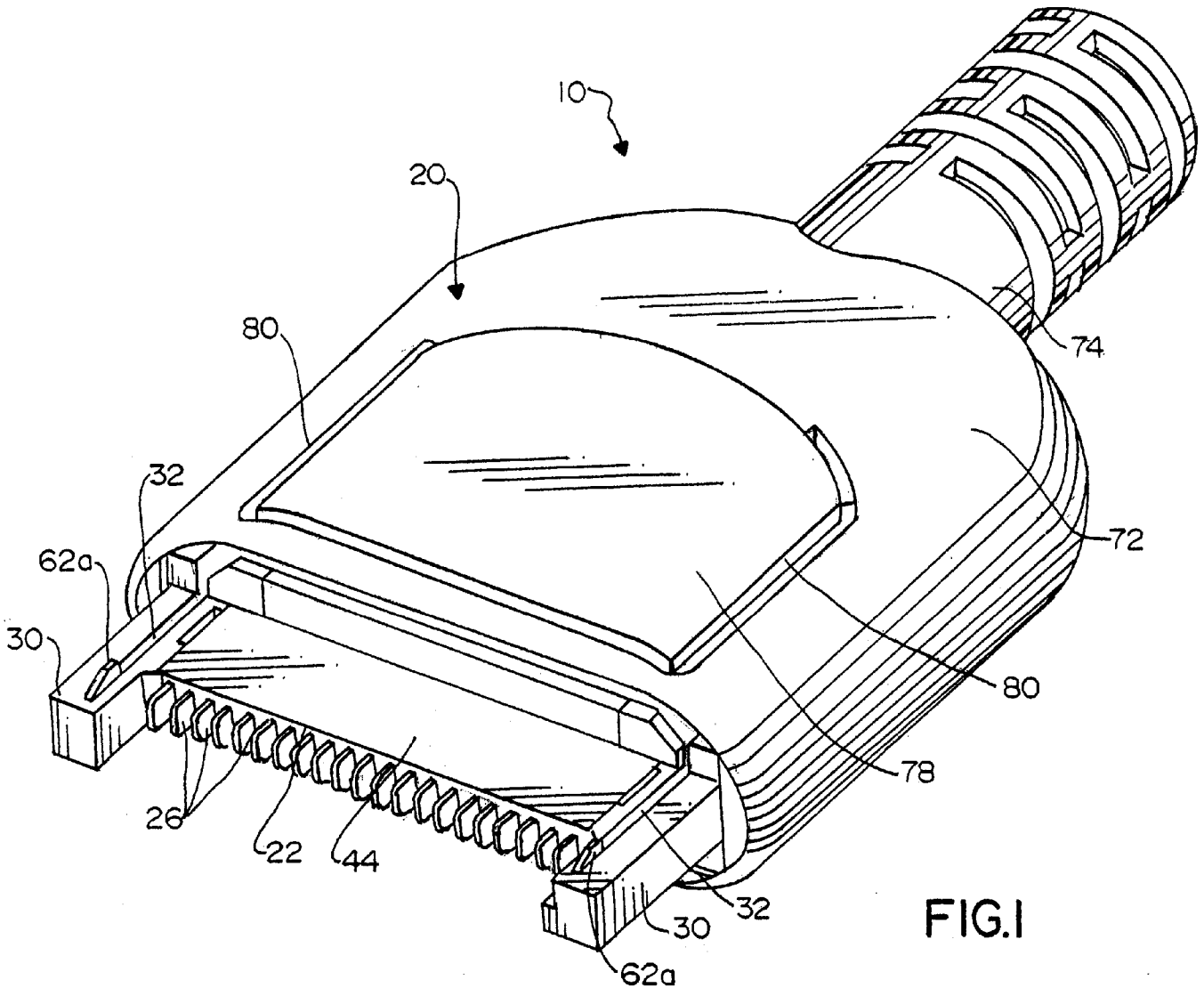
FIG. 1 is a front perspective view of one embodiment of an electrical connector incorporating the concepts of the invention.
Figure 2:
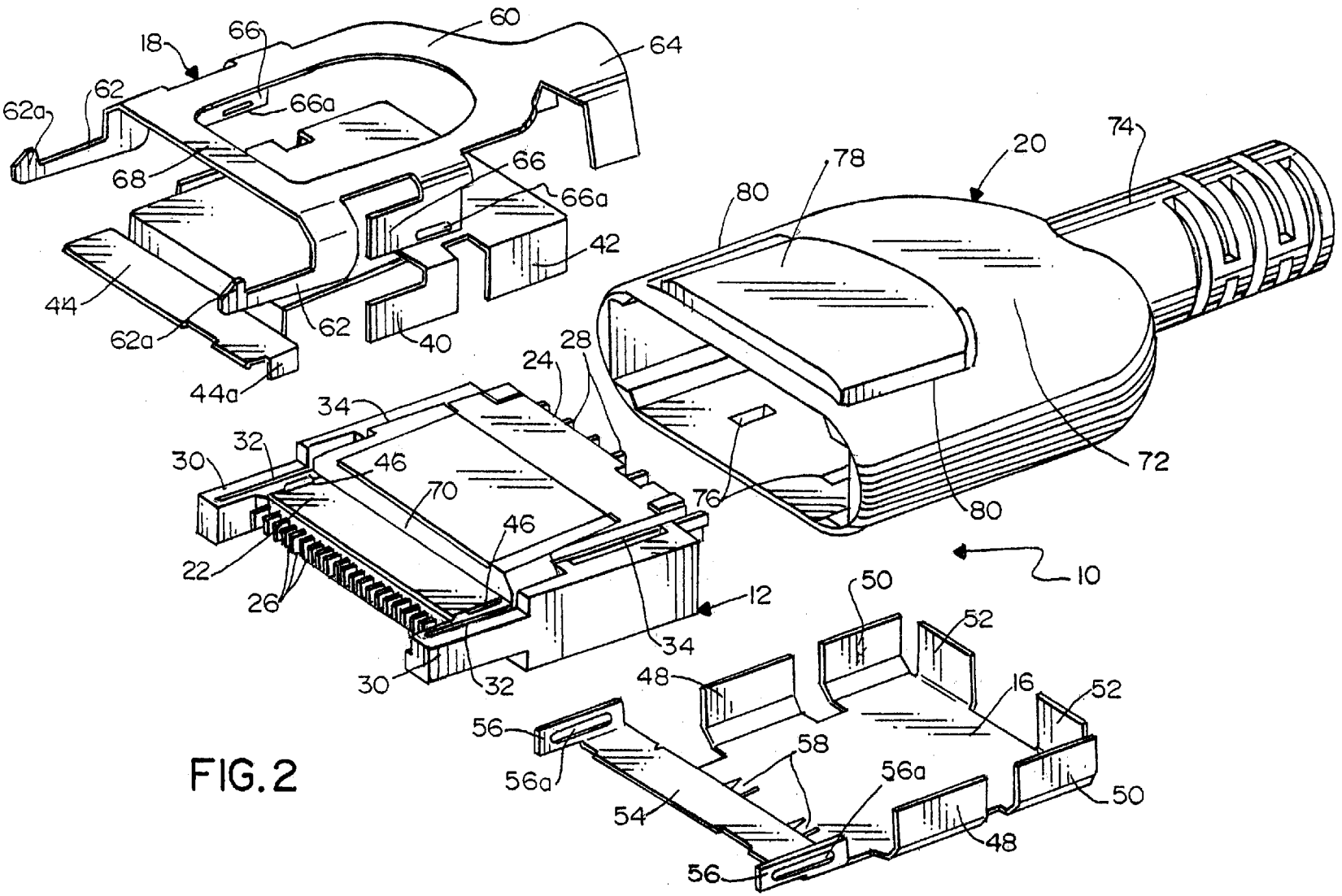
FIG. 2 is an exploded perspective view of the components of the connector oriented as in FIG. 1.
Figure 3:
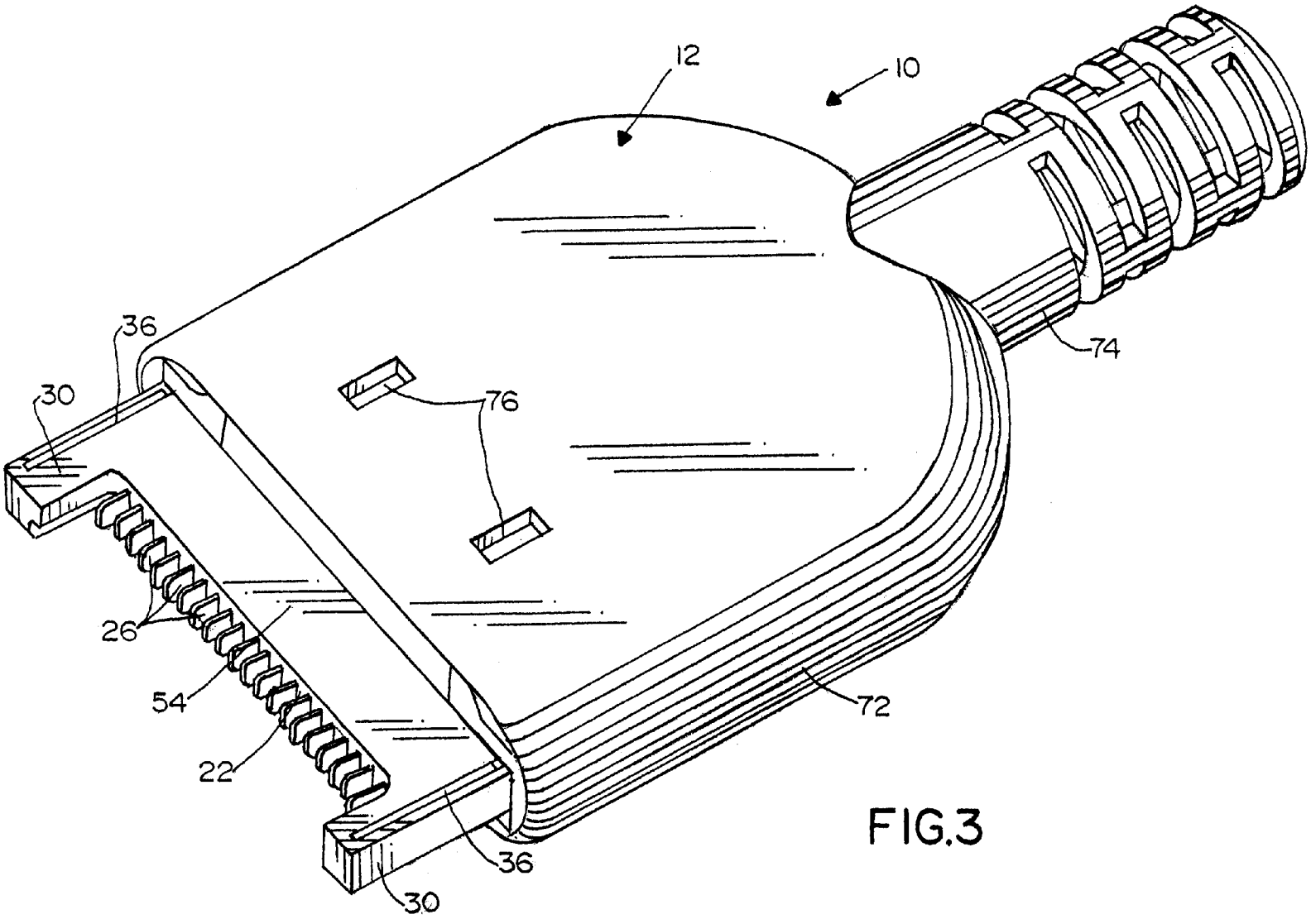
FIG. 3 is a perspective view of the connector looking at the bottom side thereof as viewed in FIG. 1.

Referring to the drawings in greater detail, and first to the embodiment of FIGS. 1–4, the invention is embodied in an electrical connector, generally designated 10. Generally, the connector includes a dielectric housing, generally designated 12, mounting a plurality of terminals described hereinafter. As viewed in the orientation of FIG. 2, a top shielding shell 14 and a bottom shielding shell 16 sandwich housing 12 therebetween. The shells may be stamped and formed of sheet metal material. A one-piece latch and strain relief device, generally designated 18, overlies top shielding shell 14. A protective elastomeric boot, generally designated 20, substantially encases the connector except for the mating end thereof, as can be seen in FIGS. 1 and 3.

More particularly, dielectric housing 12 of connector 10 includes a front mating end 22 and a rear terminating end 24. The terminals are mounted in the housing and extend generally between those ends. The terminals have front contact portions 26 projecting beyond mating end 22 of the housing for engagement with a plurality of terminals or contacts of a complementary mating connector or other connecting device. The terminals have rear portions 28 projecting rearwardly of terminating end 24 of the housing for termination to the discrete electrical wires of an electrical cable (not shown). The housing has a pair of side wing portions 30 projecting forwardly at opposite ends of front mating end 22. The top of the housing as viewed in FIG. 2, includes a slot 32 in each wing portion 30 and a pair of mounting slots 34 in the main body portion of the housing. The bottom of the housing as viewed in FIG. 4 includes a slot 36 in each wing portion 30 and a pair of mounting slots 38 in the main body portion of the housing. The entire housing may be a one-piece structure molded of dielectric material such as plastic or the like. Top shielding shell 14 includes a pair of side tabs 40 for insertion into mounting slots 34 in the housing. A pair of tabs 42 extend from the rear of the shell on opposite sides of rear terminating end 24 of the housing. A front offset portion 44 of the shell rests on top of front mating end 22 of the housing and includes a pair of small side tabs 44*a* insertable into a pair of mounting slots 46 in the housing at opposite sides of the front mating end thereof.

Figure 4:
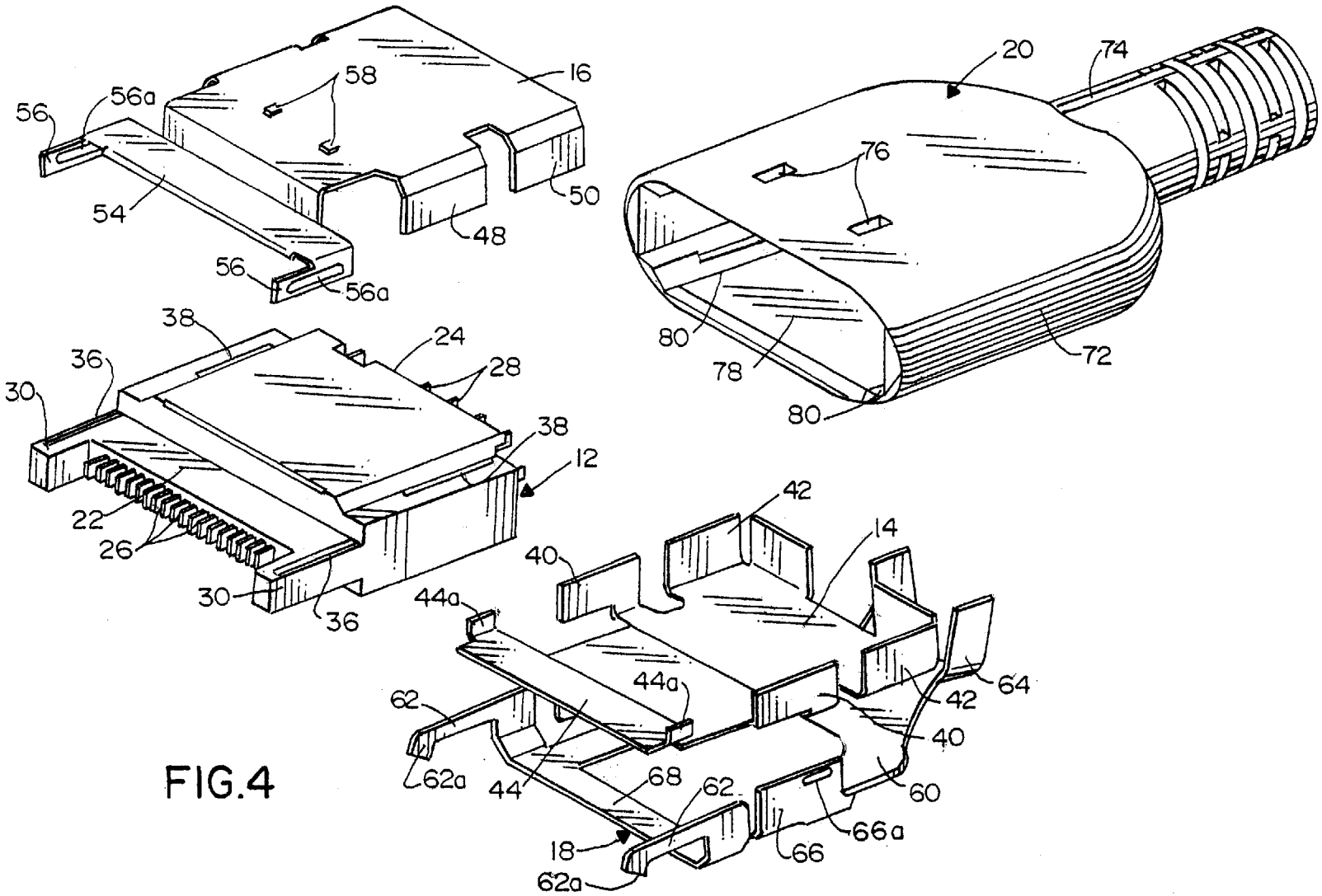
FIG. 4 is an exploded perspective view of the components of the connector oriented as in FIG. 3.

Bottom shielding shell 16 of connector 10 includes a pair of side tabs 48 for insertion into slots 38 of the housing. A second pair of side tabs 50 and a pair of rear tabs 52 substantially surround and shield the rear terminating end 24 of the housing and the terminating areas of the terminals, as at 28. The bottom shielding shell includes an offset front portion 54 which combines with portion 44 of top shielding shell 14 to sandwich front mating end 22 of the housing therebetween. A pair of support flanges 56 at opposite ends of portion 54 are press-fit into slots 36 in wing portions 30 of the housing. The support flanges are formed with bulging areas 56*a* to facilitate a tight press-fit of the support flanges within slots 36. Finally, as best seen in FIG. 4, shielding shell 16 includes a pair of locking tongues 58 stamped out of the shell and bent outwardly thereof for purposes described hereinafter.

Latch and strain relief device 18 of connector 10 is a one-piece structure stamped and formed of sheet metal material. The device includes a central body portion 60 a forward latching portion in the form of a pair of forwardly projecting latch arms 62 and a rearward strain relief portion 64. Central mounting portion 60 includes a pair of mounting tabs 66 formed on opposite sides thereof for press-fitting into mounting slots 34 of housing 12. The mounting tabs are formed with bulging portions 66*a* for establishing a tight press-fit within mounting slots 34 and 38, which, communicate with one another, and into electrical engagement with side tab 40 of the top shielding shell 14 and side tab 48 of the bottom shielding shell 16 to electrically connect the latch and strain relief device 18 to the shielding shells 14 and 16. Latch arms 62 have hooks 62*a* at the front distal ends of the arms for latching engagement with appropriate latch means of the complementary mating connector. An unlatching band 68 spans the front of latch and strain relief device 18 and is integrally connected to latch arms 62 at opposite sides of the device. Unlatching band 68 is disposed generally above shoulder 70 (FIG. 2) of housing 12 and rearward of portion 44 of top shielding shell 14, for purposes described hereinafter. Finally, rearward strain relief portion 64 is provided in the form of an open crimp ring for clamping about the electrical cable which has its discrete wires terminated to portions 28 of the terminals mounted in housing 12.

From the above description of latch and strain relief device 18, it can be understood that stresses caused by forces on latch arms 62 and/or forces on crimp ring 64 are transferred to the more robust plastic housing 12 by means of tabs 66 of the device being securely fixed within slots 34 of the housing. Therefore, the combination of the robust housing and the one-piece latch and strain relief device 18 provides a system for counteracting most excessive forces that might be applied to the connector. Mounting tab 66 includes straight edges 66*b* and 66*c* which are inserted into slots 34. When the unmated plug is pulled toward a receptacle or when a mated plug is pulled from the receptacle, the force in the boot 20 may be transferred to the housing. Straight edges 66*b* and 66*c* will contact straight walls in slots 34 providing a large contact surface reducing stresses between the latch/strain relief device and the housing.

Protective boot 20 also is a one-piece structure and is fabricated of elastomeric material. The boot includes a cup-shaped body portion 72 substantially surrounding the connector except for front mating end 22 of the housing, as seen in FIGS. 1 and 3. The boot has an integral, rearwardly extending cylindrical portion 74 which surrounds the electrical cable. The body portion has a pair of locking apertures 76 on one side thereof for receiving locking tongues 58 of shielding shell 16 to lock the boot to the connector. A depressible flap 78 is formed between a pair of slits 80 on the opposite side of the boot and a stationary bar 79. This depressible flap overlies unlatching band 68 of latch and strain relief device 18. Therefore, when it is desired to unlatch connector 10 from its mating connector or other connecting device, flap 78 is depressed inwardly against unlatching band 68 which causes latch arms 62 and latch hooks 62*a* to move radially inwardly to unlatch the mating connector. The relative movement of the depressive flap 78 and stationary bar 79 creates a desired tactile response for the user of this connector.

Figure 5:
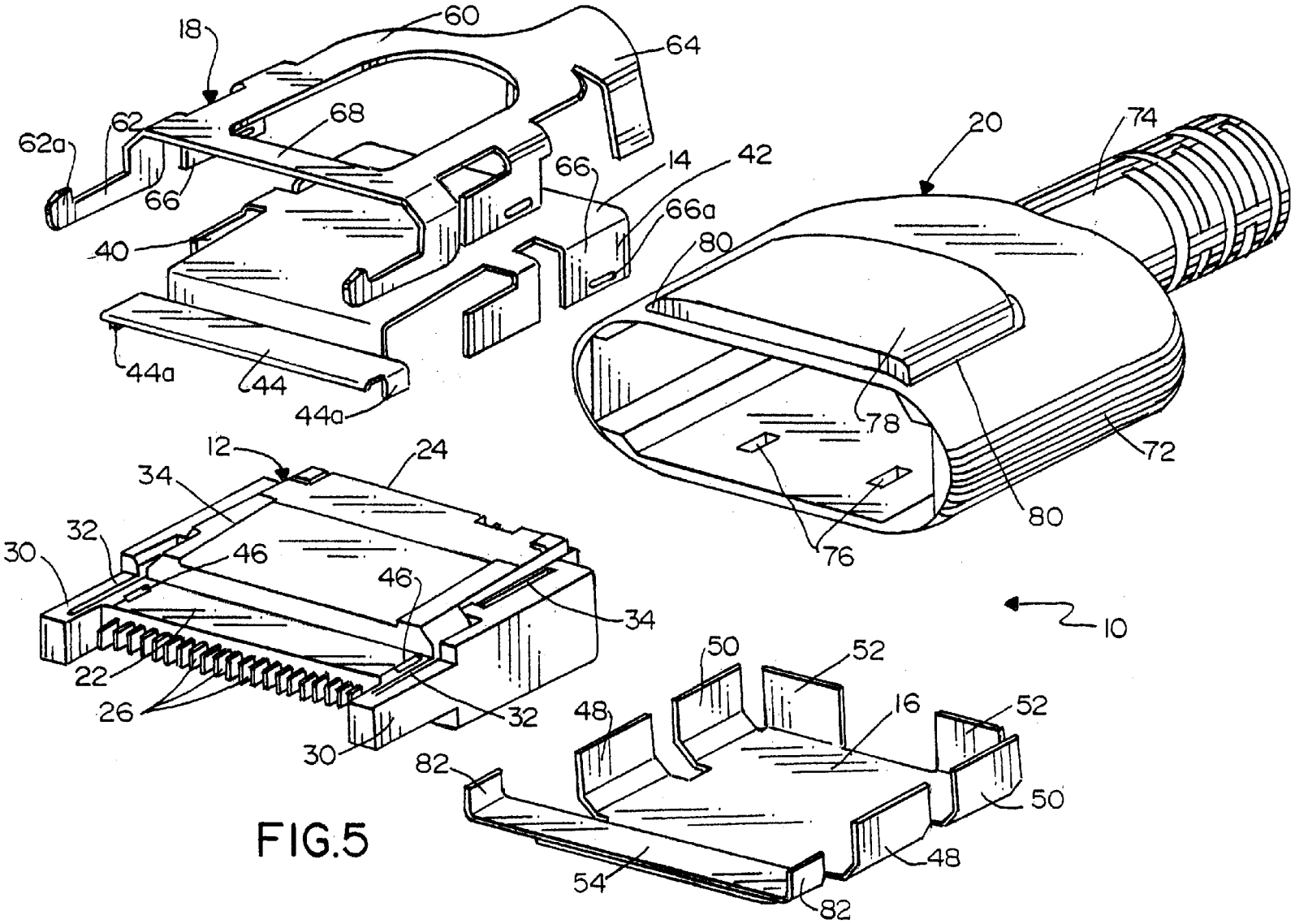
FIG. 5 is an exploded perspective view similar to that of FIG. 2, but of an alternate embodiment of the invention.

FIG. 5 shows an alternative embodiment of the invention wherein most of the components are substantially identical to those described above in relation to the embodiment of FIGS. 1–4. In particular, the one-piece latch and strain relief device 18 in FIG. 5 is substantially as described above. The only difference in the embodiment of FIG. 5 is that support flanges 56 (FIGS. 2 and 4) of bottom shielding shell 16 have been eliminated and replaced with simple side tabs 82 similar to tabs 44*a* of the top shielding shell.

Figure 6:
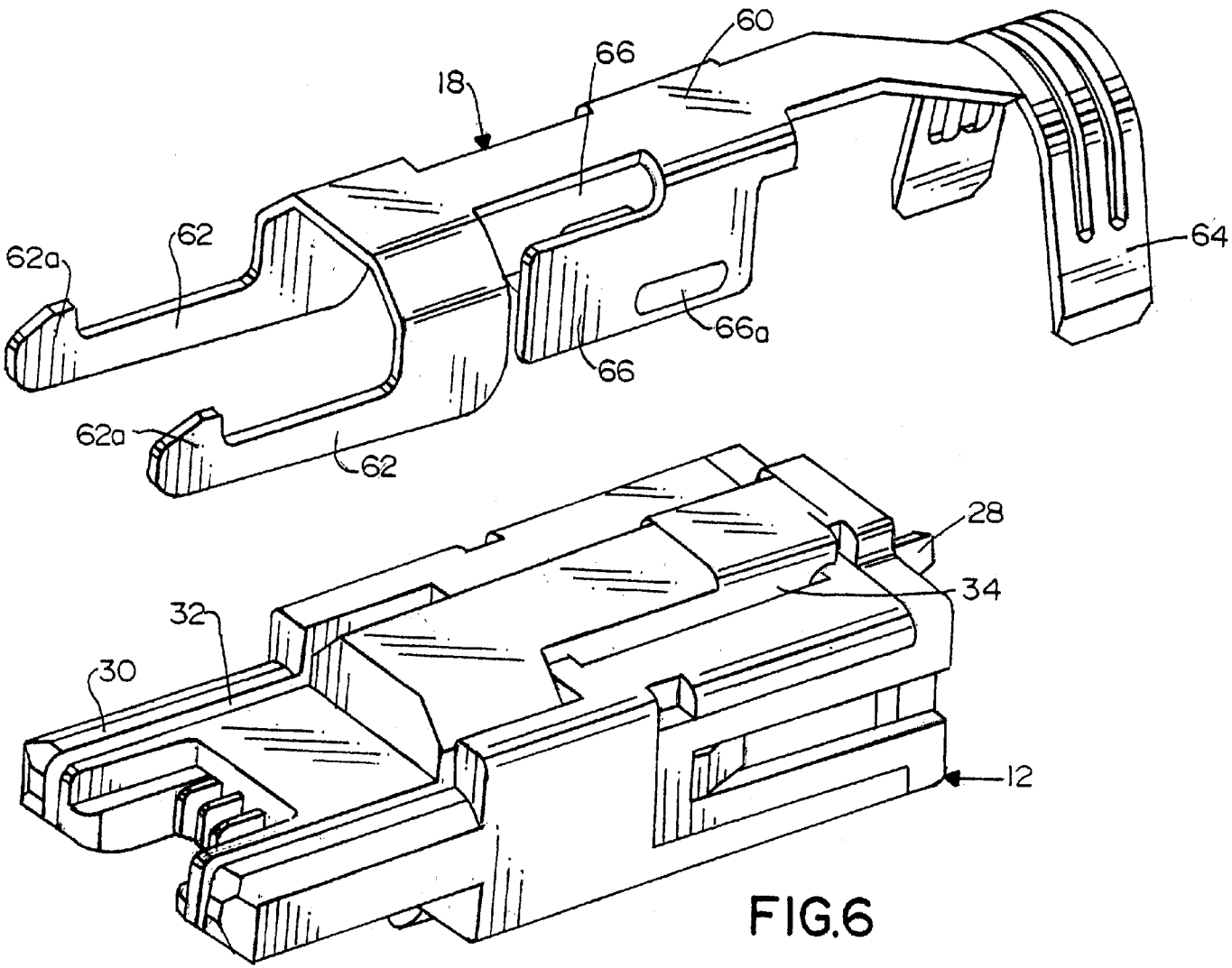
FIG. 6 is an exploded perspective view of still a further embodiment of the invention.

FIG. 6 shows a further embodiment of the invention wherein the shielding shells of the embodiments in FIGS. 1–5 have been eliminated. For consistency purposes, like numerals have been applied in FIG. 6 corresponding to like components described above in relation to the embodiments of FIGS. 1–5. In particularly, a one-piece molded plastic housing 12 has a one-piece latch and strain relief device 18 secured to the top thereof. Device 18 again is stamped and formed of sheet metal material and includes a central mounting portion 60, a forwardly latching portion defined by latch arms 62 and a rearward strain relief portion defined by crimp ring 64. A pair of mounting tabs 66 with bulging portions 66*a* depend from central mounting portion 60. Mounting tabs 66 are press-fit into a pair of slots 34 in housing 12, and latch arms 62 are disposed in a pair of slots 32 in wing portions 30 at opposite sides of front mating end 22 of the housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for terminating an electrical cable and for mating in a mating direction with a complementary mating connector, comprising:

a dielectric housing having a front mating end, a rear terminating end and a surface adapted to receive a latch and strain relief device with at least one mounting slot therein said mounting slot extending in said mating direction perpendicular into said surface;

a plurality of terminals mounted in the housing and extending generally between said ends thereof;

the one-piece latch and strain relief device including a central mounting portion, a forward latching portion and a rearward strain relief portion, said central mounting portion including a mounting tab insertable into the mounting slot in the housing, said forward latching portion being adapted for latching engagement with the mating connector, and said rearward strain relief portion being adapted for engaging the electrical cable.

2. The electrical connector of claim 1 wherein said one-piece latch and strain relief device is stamped and formed of sheet metal material.

3. The electrical connector of claim 1 wherein said forward latching portion comprises at least one forwardly projecting latch arm.

4. The electrical connector of claim 1 wherein said forward latching portion comprises a pair of hooked latch arms located at opposite sides of said front mating end of the housing.

5. The electrical connector of claim 2 wherein said forward latching portion comprises a pair of said latch arms at least partially supported in latch arm receiving slots in the housing at opposite sides of said front mating end of the housing.

6. The electrical connector of claim 1 wherein said rearward strain relief portion comprises a crimp portion for clamping onto the electrical cable.

7. The electrical connector of claim 1 wherein said central mounting portion includes a pair of said mounting tabs press-fit into a pair of said mounting slots at opposite sides of the housing.

8. An electrical connector for terminating an electrical cable and for mating in a mating direction with a complementary mating connector, comprising:

a dielectric housing having a front mating end, a rear terminating end and a surface adapted to receive a latch and strain relief device with at least one mounting slot therein, said mounting slot extending in said mating direction perpendicular into said surface;

a plurality of terminals mounted in the housing and extending generally between said ends thereof;

the one-piece latch and strain relief device stamped and formed of sheet metal material and including a central mounting portion, a forward latching portion and a rearward strain relief portion, said central mounting portion including a mounting tab insertable into the mounting slot in the housing, said forward latching portion including at least one forwardly projecting latch arm for latching engagement with the mating connector, and said rearward strain relief portion including a crimp member for clamping onto the electrical cable.

9. The electrical connector of claim 8, wherein said forward latching portion comprises a pair of hooked latch arms located at opposite sides of said front mating end of the housing.

10. The electrical connector of claim 8 wherein said forward latching portion comprises a pair of said latch arms at least partially supported in latch arm receiving slots in the housing at opposite sides of said front mating end of the housing.

11. The electrical connector of claim 8 wherein said central mounting portion includes a pair of said mounting tabs press-fit into a pair of said mounting slots at opposite sides of the housing, each mounting tab having opposite straight edges engagable with straight edges of said mounting slots.

12. An electrical connector for mating with a complementary mating connector, comprising:

a dielectric housing having a front mating end, a rear terminating end and at least one mounting slot therein, said mounting slot extending in a mating direction perpendicular into said surface;

a plurality of terminals mounted in the housing and extending generally between said ends thereof;

a one-piece latch and strain relief device stamped and formed of sheet metal material including a mounting portion and a forward latching portion, said mounting portion including a mounting tab insertable into the mounting slot in the housing, and said forward latching portion being adapted for latching engagement with the mating connector; and a first shielding shell member beneath said one piece latch and strain relief device.

13. The electrical connector of claim 12 wherein said first shielding shell member includes a mounting tab insertable into said mounting slot in the housing.

14. The electrical connector of claim 13 wherein said forward latching portion comprises at least one forwardly projecting latch arm.

15. The electrical connector of claim 13 wherein said forward latching portion comprises a pair of hooked latch arms at opposite sides of said front mating end of the housing.

16. The electrical connector of claim 13 including a second shielding shell member stamped and formed of sheet metal material having side tabs disposed in a second mounting slot in the housing.

17. The electrical connector of claim 12 wherein said forward latching portion comprises a pair of said latch arms at least partially supported in slots in the housing at opposite sides of said front mating end of the housing.

18. The electrical connector of claim 12 wherein said mounting portion includes a pair of said mounting tabs press-fit into a pair of said mounting slots at opposite sides of the housing.

* * * * *